US005138381A

United States Patent [19]

Masaki et al.

[11] Patent Number: 5,138,381

[45] Date of Patent: Aug. 11, 1992

[54] IMAGE FORMING APPARATUS EQUIPPED WITH SEPARATING PAWL WITH SPECIFIED SURFACE ROUGHNESS

[75] Inventors: Kenji Masaki, Ibaraki; Shuji Iino, Hirakata; Isao Doi, Toyonaka; Izumi Osawa, Ikeda, all of Japan

[73] Assignee: Minolta Camera Kabushiki Kaisha, Osaka, Japan

[21] Appl. No.: 634,496

[22] Filed: Dec. 27, 1990

[30] Foreign Application Priority Data

Dec. 27, 1989 [JP] Japan ..... 1-343557

[51] Int. Cl.[5] ..... G03G 13/00

[52] U.S. Cl. ..... 355/210; 355/315; 430/66

[58] Field of Search ..... 355/210, 211, 212, 315, 355/245; 428/442, 463; 430/66, 76, 84, 85, 65

[56] References Cited

U.S. PATENT DOCUMENTS

| | | | |
|---|---|---|---|
| 4,801,515 | 1/1989 | Iino et al. | 430/66 |
| 4,882,256 | 11/1989 | Osawa et al. | 430/66 |
| 4,886,724 | 12/1989 | Masaki et al. | 430/66 |
| 4,902,595 | 2/1990 | Masaki et al. | 430/66 |
| 4,933,247 | 6/1990 | Osawa et al. | 430/66 |
| 4,988,571 | 1/1991 | Ueda | 428/412 |
| 5,006,447 | 4/1991 | Umeda et al. | 430/272 |

FOREIGN PATENT DOCUMENTS

| | | |
|---|---|---|
| 57-30844 | 2/1982 | Japan . |
| 59-58437 | 4/1984 | Japan . |
| 59-149158 | 10/1984 | Japan . |
| 0182445 | 9/1985 | Japan . |
| 63-81430 | 4/1988 | Japan . |
| 3159863 | 7/1988 | Japan . |
| 1134458 | 5/1989 | Japan . |

*Primary Examiner*—A. T. Grimley
*Assistant Examiner*—T. A. Dang
*Attorney, Agent, or Firm*—Willian, Brinks, Olds, Hofer, Gilson & Lione

[57] ABSTRACT

This invention relates to an image forming apparatus, an image forming method and a separating device, using a separating pawl brought into contact with a surface of the photosensitive member, characterized in that maximum surface roughness of portions, where the separating pawl is brought into contact with the photosensitive member, is smaller than a layer-thickness of the surface protective layer.

6 Claims, 9 Drawing Sheets

IMAGE FORMING APPARATUS EQUIPPED WITH SEPARATING PAWL WITH SPECIFIED SURFACE ROUGHNESS

BACKGROUND OF THE INVENTION

The present invention relates to an electrophotographic apparatus forming an image by utilizing an electrophotographic process such as a copying machine, a printer and a facsimile, in particular to an electrophotographic apparatus provided with a transfer paper-separating mechanism for pressing separating pawls against a surface of a photosensitive member to separate a transfer paper from the surface of the photosensitive member.

In order to prevent the transfer paper from being wound around the surface of the photosensitive member by an electrostatic adsorption and the like to produce a trouble generally called a jamming after a transference of a toner image formed on the surface of the photosensitive member onto the transfer paper, the electrophotographic apparatus, such as a copying machine, a printer and a facsimile, has been provided with the transfer paper-separating mechanism in which the separating pawls are pressed against the surface of the photosensitive member to separate the transfer paper from the surface of the photosensitive member by means of the separating pawls after the transference.

Such the separating pawls are generally made with a resin, such as polycarbonate or the like, and a metal such as stainless steel or the like.

On the other hand, with respect to the photosensitive member used in the above described electrophotographic apparatus, the photosensitive members provided with various kinds of surface protective layers formed on the surface thereof have been proposed in order to improve various kinds of physical properties influenced by surface properties and conditions thereof. For example, a selenium photosensitive member provided with an amorphous carbon layer formed on a surface thereof has been disclosed in U.S. Pat. No. 4,801,515 and an organic photosensitive member provided with an amorphous carbon layer formed thereon has been disclosed in U.S. Pat No. 4,882,256.

The surface protective layer formed on the surface of the photosensitive member generally aims at a prevention of electric charges from being injected into a photosensitive layer from the surface of the charged photosensitive member, an improvement of the photosensitive member in chargeability, a prevention of harmful lights from being incident upon the photosensitive layer by absorbing the harmful lights by the surface protective layer formed on the surface of the photosensitive member, an increase of a surface hardness of the photosensitive member to improve the wearing resistance thereof and the like.

However, even though the surface protective layer is formed on the surface of the photosensitive member for the above described aims, there are also problems such that when the separating pawls are pressed against the surface of the photosensitive member in the above described manner, stripe-like scratches are formed on the surface protective layer formed on the surface of the photosensitive member to hinder the above described aims of the surface protective layer. Various kinds of stripe-like image noises are generated.

For example, if the above described stripe-like scratches are formed in the surface protective layer formed on the surface of the photosensitive member in order to prevent the electric charges from being injected from the surface of the photosensitive member, an effect of suppressing an injection of the electric charges is lost in these scratched portions and thus the electric charges are injected into the photosensitive layer through the scratched portions, whereby a surface electric potential in these portions is reduced and white stripe-like image noises appear.

In addition, if the above described stripe-like scratches are formed in the surface protective layer formed on the surface of the photosensitive member in order to prevent the harmful lights from being incident upon the photosensitive layer, there arises such a trouble that an absorption of the harmful lights in these scratched portions is hindered and thus all the incident lights arrive at the photosensitive layer, whereby a sensitivity is increased in these scratched portions and white stripe-like image noises appear, and, if a use of the photosensitive member is further continued under this condition, the harmful lights are continued to be incident upon the photosensitive layer, at these scratched portions and thus the sensitivity is gradually reduced, whereby black stripe-like image noises appear.

Furthermore, if the above described stripe-like scratches are formed in the photosensitive layer formed in order to improve a wearing resistance of the photosensitive member, in the case where such the photosensitive member is charged by the use of a scorotron charger, surface charges in these scratched portions are increased, a sensitivity is reduced, and black stripe-like image noises are generated.

And, such the scratches of the photosensitive member formed by the separating pawls are notable in the photosensitive member constituted of the surface protective layer having a high hardness and the photosensitive layer having a hardness lower than that of the surface protective layer. It can be supposed that it is a reason of the above described matter that the photosensitive layer having a lower hardness is distorted by a pressed contact of the separating pawls with the photosensitive member but the surface protective layer having a higher hardness can not be distorted to be cracked. And, such the phenomenon is notable when the photosensitive member is being driven in a high speed. In particular, when the photosensitive member is cylindrical and rotatably driven at a speed of 30 cm/sec or more in a tangential direction, the above described phenomenon is notable.

Besides, such the scratches in the photosensitive member resulting from the separating pawls are notable in the case where the photosensitive member comprises the surface protective layer made of amorphous carbon containing at least a carbon atom obtained by subjecting a carbon-containing organic compound to a plasma-discharging decomposition followed by a recombination by an electro-magnetic force and the like. It is supposed that it is a reason of the above described matter that the surface protective layer obtained by such the method has a friction factor remarkably higher than that of the surface protective layer obtained by other methods, for example by applying a resin by a spray coating method or a dipping method, so that the protective layer is rapidly worn by the separating pawls. In addition, this abrasion is notable in the case where the photosensitive member is being driven in a high speed. In particular, when the photosensitive member is cylindrical and rotatably driven at a speed of 30 cm/sec or more in a tangential direction, the abrasion is notable.

SUMMARY OF THE INVENTION

It is a first object of the present invention to provide an image-forming apparatus provided with a mechanism for pressing separating pawls against a surface of a photosensitive member to separate a transfer paper from the surface of the photosensitive member wherein white stripes and black stripes caused by the surface of the photosensitive member scratched by the separating pawls are not produced on a copied image.

It is a second object of the present invention to provide an image-forming apparatus provided with a mechanism for pressing separating pawls against a surface of a photosensitive member comprising a surface protective layer having a high hardness and a photosensitive layer having a hardness lower than that of the surface protective layer to separate a transfer paper from the surface of the photosensitive member wherein white stripes and black stripes caused by the surface of the photosensitive member scratched by the separating pawls are not produced on a copied image.

It is a third object of the present invention to provide an image-forming apparatus provided with a mechanism for pressing separating pawls against a surface of a photosensitive member comprising a surface protective layer made with amorphous carbon containing at least a carbon atom obtained by subjecting a carbon-containing organic compound to a plasma discharging decomposition followed by a recombination by an electromagnetic force and the like to separate a transfer paper from the surface of the photosensitive member wherein white stripes and black stripes caused by the surface of the photosensitive member scratched by the separating pawls are not produced on a copied image.

It is a fourth object of the present invention to provide an image-forming apparatus provided with a mechanism for pressing separating pawls against a surface of a photosensitive member moving in a high speed to separate a transfer paper from the surface of the photosensitive member wherein white stripes and black stripes caused by the surface of the photosensitive member scratched by the separating pawls are not produced on a copied image.

DETAILED DESCRIPTION OF THE INVENTION

One preferred embodiment of an image-forming apparatus according to the present invention will be described below with reference to the attached drawings.

Figure 1:
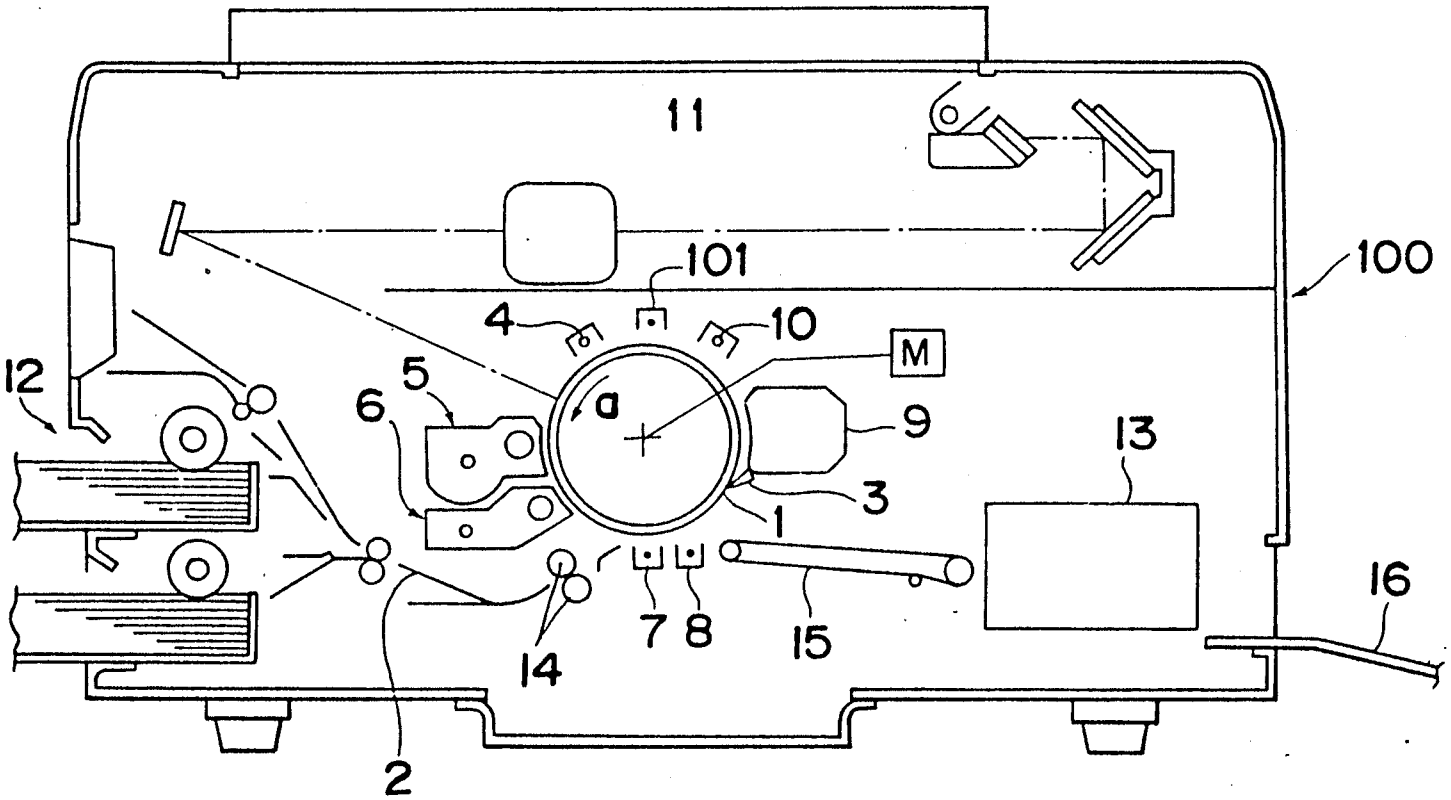
FIG. 1 shows an schematic view of one of copying machines installed with an image forming apparatus of the present invention.

As shown in FIG. 1, a photosensitive member drum (1) is pivoted at a nearly central position within a copying machine body (100) so as to be rotatably driven in a direction shown by an arrow (a) by means of a main motor (M). A charger (101), an inter-image eraser (4), a first developing unit of magnetic brush type (5), a second developing unit of magnetic brush type (6), a transfer charger (7), a separating charger (8), a cleaning device (9) and a main eraser (10) are arranged around the photosensitive member drum (1) in order with appointed intervals. In addition, an optical system (11) is provided above the photosensitive member drum (1) and its peripheral instruments, a paper-supplying portion (12) on the left side of the photosensitive member drum (1) and its peripheral instruments, and a fixing device (13) on the right side of the photosensitive member drum (1) and its peripheral instruments. Furthermore, three or more pieces of developing unit may be used.

The optical system (11) is the one of a slit exposure-type by a mirror-scanning and forms an electrostatic latent image corresponding to an image of a manuscript on a surface of the photosensitive member drum (1).

Toners supplied from the first developing unit (5) or the second developing unit (6), which is selectively used, are adhered to the surface of the photosensitive member drum (1) to develop the electrostatic latent image by the toners. The electrostatic latent image corresponding to the image of the manuscript becomes visible.

On the other hand, a copying paper (2) supplied from the paper-supplying portion (12) is conveyed onto the surface of the photosensitive member drum (1) through a pair of timing rollers (14) in synchronization with a timing signal and the toner image is transferred onto the copying paper (2) by a corona discharge of the transfer charger (7) followed by immediately separating the copying paper (2) from the surface of the photosensitive member drum (1) by discharge by an alternative electric field of the separating charger (8), stiffness of the copying paper (2) itself and separating pawls (3). That is to say, the separating pawls (3) are brought into contact with the surface of the photosensitive member drum (1) down the transfer charger (7) and the separating charger (8) in the revolving direction (a) of the photosensitive member, whereby the copying paper (2) conveyed through the timing rollers (14) is separated from the photosensitive member drum (1).

And, the copying paper separated from the photosensitive member drum (1) is conveyed by means of a conveying belt (15) to the fixing device (13), where the toner image is heated to be fixed, to be discharged onto a tray (16).

Toners remained on the surface of the photosensitive member drum (1) are removed by means of the cleaning device (9) and charges remained on the surface of the photosensitive member drum (1) are erased by means of the main eraser (10).

Figure 2:
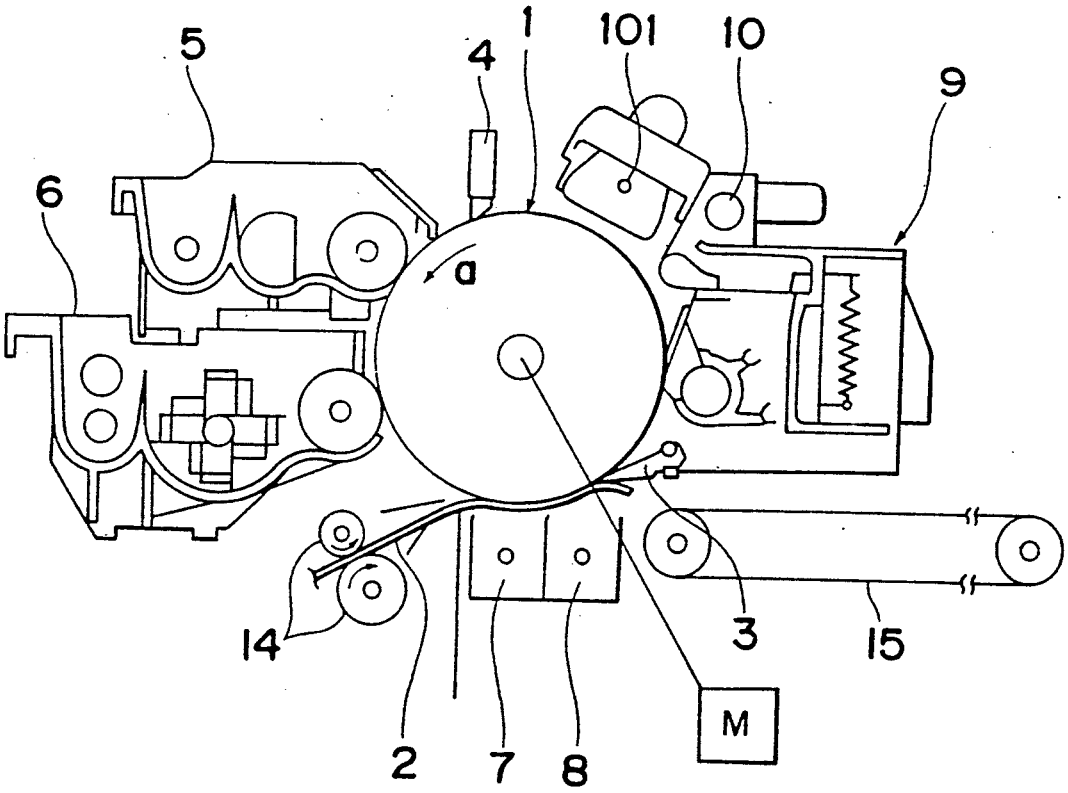
FIG. 2 shows another schematic view of one of copying machines equipped with an image forming apparatus of the present invention.
Figure 3:
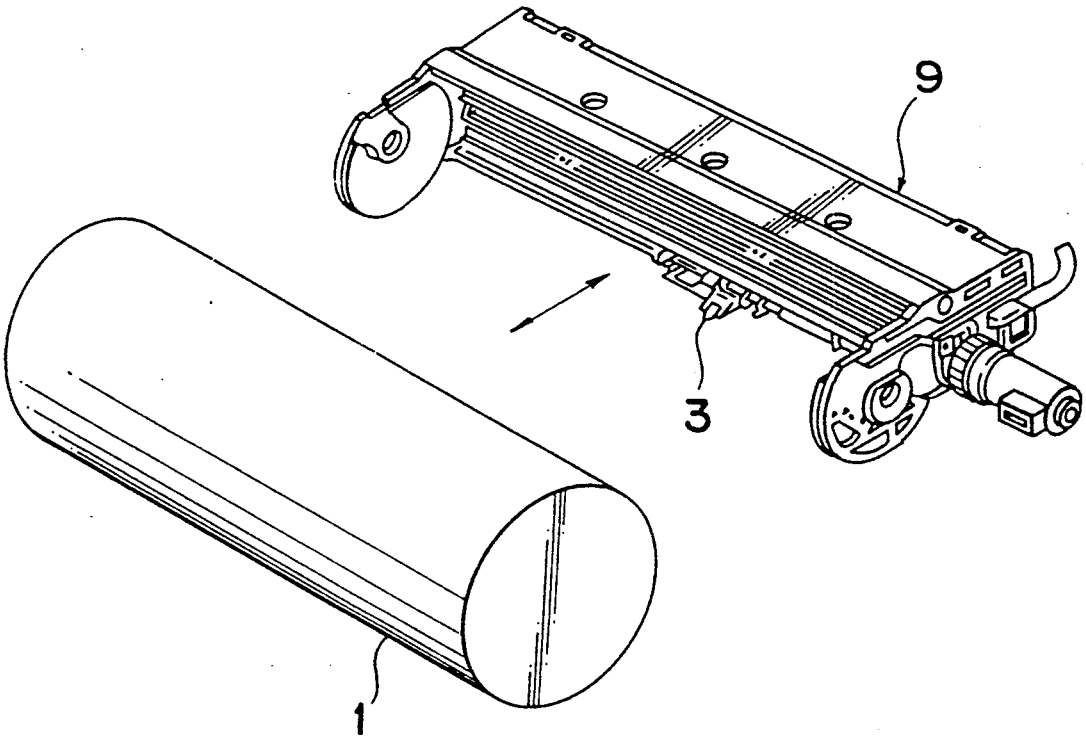
FIG. 3 shows a perspective view of a cleaning device equipped with a separating pawl, which is separable from a photosensitive member.

In addition, in the case shown in FIG. 2, separating pawls (3) are installed at the lower position of a cleaning device (9), which is provided separably from a photosensitive member (1), as shown in FIG. 3.

Figure 4:
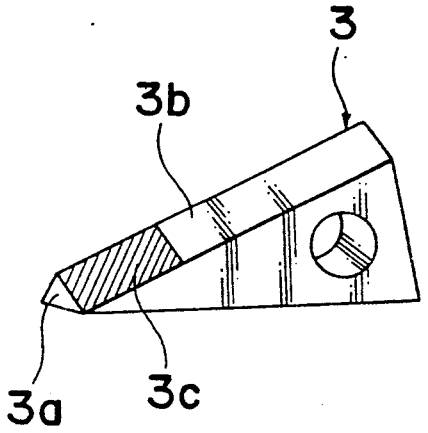
FIG. 4 shows a perspective view of one of separating pawls.
Figure 5:
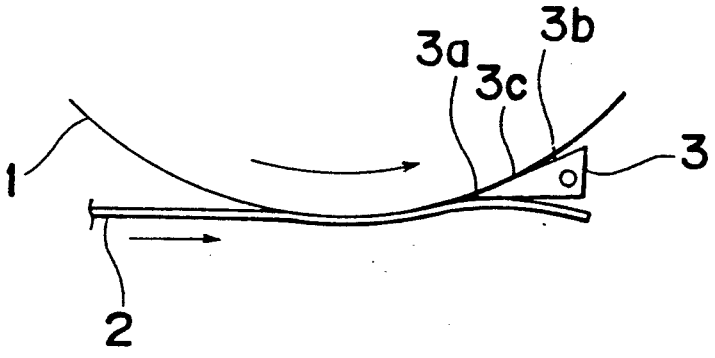
FIG. 5 shows to explain how to use a separating pawl.

In this preferred embodiment, the separating pawls (3) which is brought into contact with the surface of the photosensitive member (1) to separate the transfer paper (2) from the surface of the photosensitive member (1), as shown in FIG. 4, 5, is formed with a metal, preferably stainless steel, so that the end shape of the separating pawls and the face thereof may not be changed even after repeated contact thereof with the surface of the photosensitive member (1), but they may be also formed with a resin, such as polyimide, polyamide, polycarbonate or the like.

And, when the separating pawls (3) formed in such the wedge-like shape are brought into contact with the surface of the photosensitive member (1) to separate the transfer paper (2) from the surface of the photosensitive member (1), the inclined surface portions (3*b*) positioned slightly behind the wedge-like shaped end portions (3*a*) of the separating pawls (3) are brought into contact with the surface of the photosensitive member (1). A maximum surface roughness of contact portions (3*c*) in the inclined surface portions (3*b*) is set so as to be smaller than a layer-thickness of a surface protective layer formed on a surface of a photosensitive layer of the photosensitive member (1).

The maximum surface roughness in the present invention means a 10 point-mean roughness measured in accordance with JIS-B0601. That is to say, the maximum surface roughness is a difference (μm) between a mean value of heights of the five highest peak and a mean value of the five lowest heights measured in a direction of vertical magnification from a straight line, which runs in parallel to an average line and does not cross a section curve, in a portion extracted from the section curve by a standard length.

An example of a method of determining the 10 point-mean roughness is shown in FIG. 1.

Figure 6:
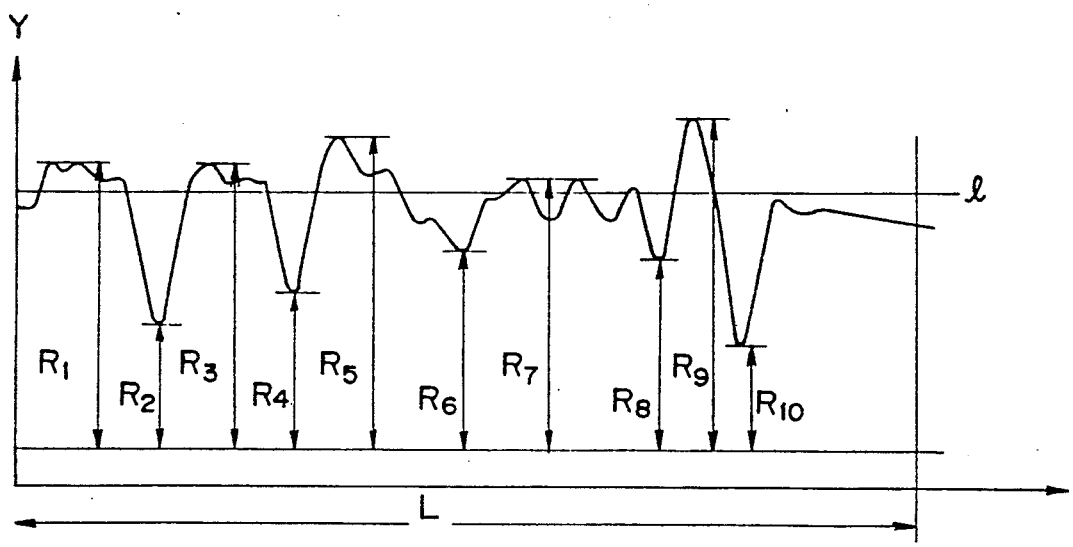
FIG. 6 shows to explain how to measure ten-point mean roughness.

Referring to FIG. 6, L designates the standard length and "l" designates the average line. Y designates the direction of vertical magnification and X designates the recording direction of 10 point mean roughness. $R_1$, $R_3$, $R_5$, $R_7$, $R_9$ designate the heights of the five highest peaks in the extracted portion corresponding to the standard length L. $R_2$, $R_4$, $R_6$, $R_8$, $R_{10}$ designate the heights of the five lowest bottoms in the extracted portion corresponding to the standard length. Here, the 10 point-mean roughness ($R_z$) is defined by the following formula:

$$R_z = \frac{\{(R_1 + R_3 + R_5 + R_7 + R_9) - (R_2 + R_4 + R_6 + R_8 + R_{10})\}}{5}$$

In the present invention, the standard length (L) is 0.25 mm in the measurement of the 10 point mean roughness.

Furthermore, it is preferable that a pressing force in the normal direction of the contact portions (3*c*) of the separating pawls against the surface of the photosensitive member (1) is set at about 0.5 to 5 g/mm. If the pressing force is 0.5 g/mm or less, a damage against the surface of the photosensitive member (1) is reduced but the pressing force may be too small to completely separate the transfer paper (2). If the pressing force is 5 g/mm or more, no matter how smoothly the separating pawls (3) are formed, the damage against the photosensitive member (1) can not be disregarded. The engaging portions (3*c*) of the separating pawls (3) are formed of a simple plane surface in the present preferred embodiment. The shape of the separating pawls according to the present invention, however, is not limited by this. The separating pawls may be formed or used as shown in supplementary FIGS. 7 to 13.

Figure 7:
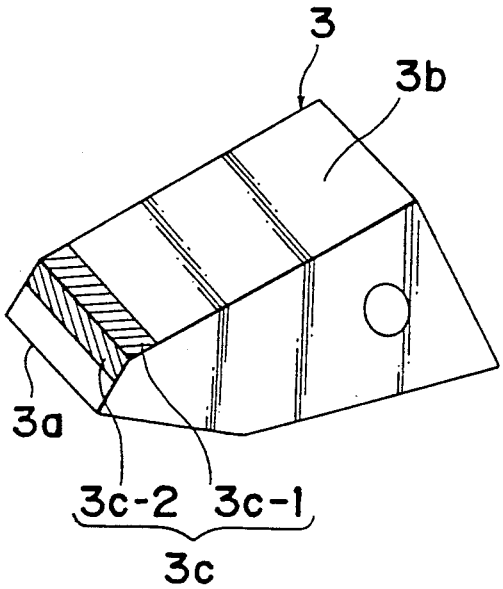
FIG. 7 shows a perspective view of one of separating pawls.
Figure 8:
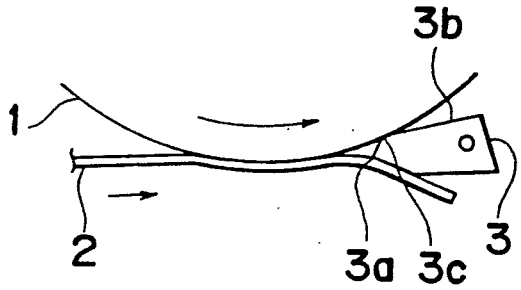
FIG. 8 shows to explain how to use a separating pawl.

As shown in FIG. 7 and FIG. 8, the separating pawl of which contact portion (3*c*) brought into contact with the photosensitive member (1) have two plane surfaces (3*c*-1), (3*c*-2) forming a crest line formed on the separating pawl is used.

And, it is preferable that the separating pawl formed with metal, for example stainless steel, which can prevent the shape of the end and surface from being changed even after the repeated contacts thereof with the surface of the photosensitive member (1).

In this case, the surface roughness of both the two plane surfaces (3*c*-1), (3*c*-2) is set so as to be smaller than the layer-thickness of the surface protective layer formed on the surface of the photosensitive member (1).

Figure 9:
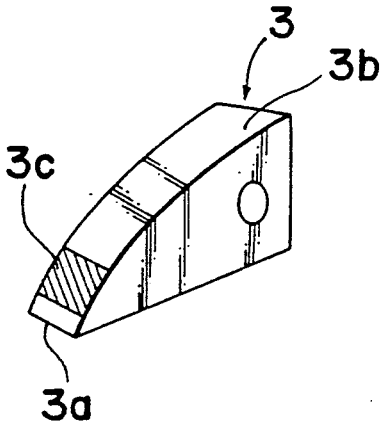
FIG. 9 shows a perspective view of one of separating pawls.
Figure 10:
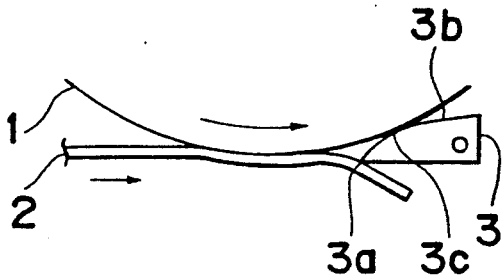
FIG. 10–FIG. 13 show to explain how to use a separating pawl.

As shown in FIG. 9 and FIG. 10, the separating pawl of which contact portion (3*c*) brought into contact with the photosensitive member (1) form a curved surface is used.

The separating pawl is also formed with stainless steel, which can prevent the shape of the end and surface from being changed even after the repeated contacts thereof with the surface of the photosensitive member (1).

The surface roughness of the contact portions (3*c*) brought into contact with the surface of the photosensitive member (1) is set so as to be smaller than the layer-thickness of the surface protective layer formed on the surface of the photosensitive member (1).

Figure 11:
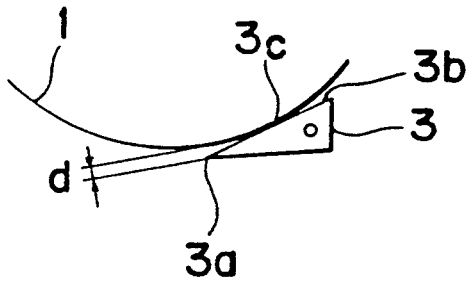
Figure 12:
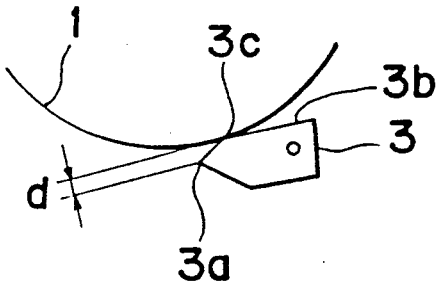
Figure 13:
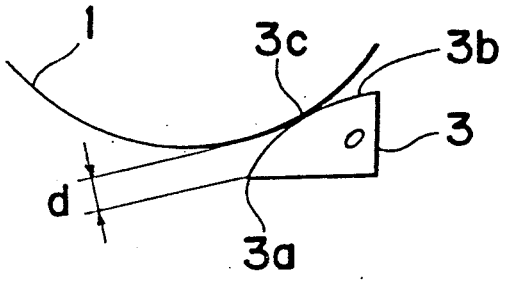

It is preferable that the respective separating pawls as shown in FIGS. 11 to 13 have a shape, in which the end portions (3*a*) thereof are not brought into direct contact with the photosensitive member, because such the shape can lead to a suitable setting of the surface roughness of the separating pawls in the contact portions (3*c*) brought into contact with the photosensitive member.

In this case, it is preferable that a rise of the pointed ends, that is a distance between the surface of the photosensitive member (1) and the ends (3*a*) of the separating pawls (designated by "d" in FIGS. 11 to 13) in the direction of diameter in a section of the photosensitive member (1), is at most ½ times the thickness of the transfer paper so that the transfer paper (2) used may not be jammed in the gap. Since the transfer paper is usually about 100 μm thick, it is preferable that a value of this d is at most about 50 μm.

In addition, the separation pawls according to the present invention, in which the maximum surface roughness of the contact portions (3*c*) brought into contact with the photosensitive member (1) is set so as to be smaller than the layer-thickness of the photosensitive layer of the photosensitive member, are in particular effective in the case where a Vickers hardness of the photosensitive layer of the photosensitive member is about 5 to 100 and that of the surface protective layer is 200 to 10,000. Such the photosensitive member includes the one comprising an organic photosensitive layer composed of a binder resin, a charge-generating material or a charge-transporting material and a surface protective layer such as an amorphous carbon layer and an amorphous silicon layer formed by a plasma polymerization method, a vacuum deposition method or the like.

Such the photosensitive member has a structure in which the remarkably hard surface protective layer is formed on a remarkably soft undercoat, that is the photosensitive layer, so that the present inventors have found a special problem that the hard surface protective layer is cracked to be broken on the soft photosensitive layer unless the contact portions (3c) of the separating pawls (3) are formed so as to be smooth. However, the present inventors have found that such the problem can be solved by setting the maximum surface roughness of the contact portions (3c) of the separating pawls (3) brought into contact with the photosensitive member so as to be smaller than the layer-thickness of the surface protective layer formed on the photosensitive layer having the above described Vickers hardness.

In addition, the above descried breakage of the surface protective layer comes into particular problem in the case where not only the photosensitive layer and the surface protective layer have the above described Vickers hardness but also the layer-thickness of the soft photosensitive layer, such as a charge-transporting layer of a function divided type photosensitive member formed immediately under the surface protective layer and the photosensitive layer of a single-layer photosensitive member with a photoelectrically conductive substance dispersed therein is 10 to 40 μm and the layer-thickness of the surface protective layer formed on the photosensitive layer is 0.01 to 5 μm. In such a case, it is in particular effective that the maximum surface roughness of the engaging portions (3c) of the separating pawls (3) is set so as to be smaller than the layer-thickness of the surface protective layer. And, it is most effective that an absolute value of the maximum surface roughness is about 0.005 to 3 μm.

Next, an on-off mechanism for bringing the separating pawl (3) into contact with the surface of the photosensitive member (1) in synchronization with a timing of providing the transfer paper (2) for the photosensitive member (1) is described.

Figure 14:
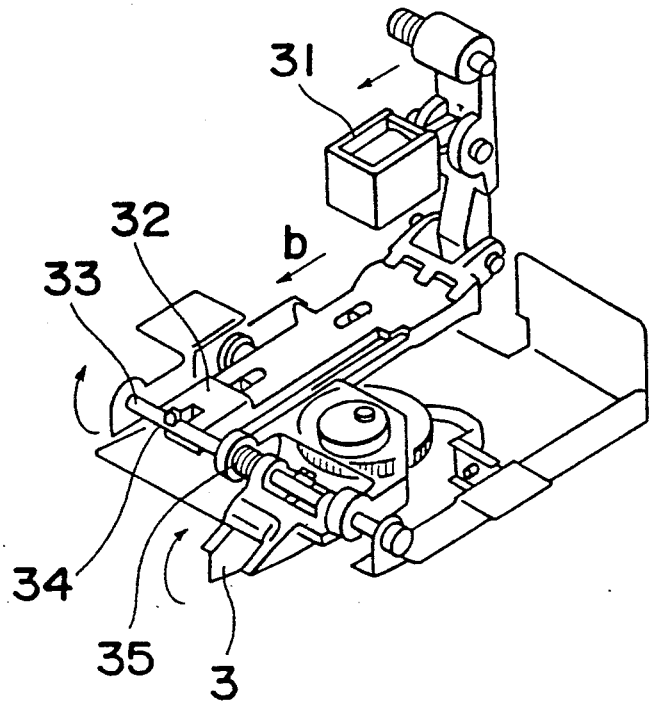
FIG. 14 and FIG. 15 show to explain an on-off mechanism for bringing a separating pawl into contact with a surface of a photosensitive member.
Figure 15:
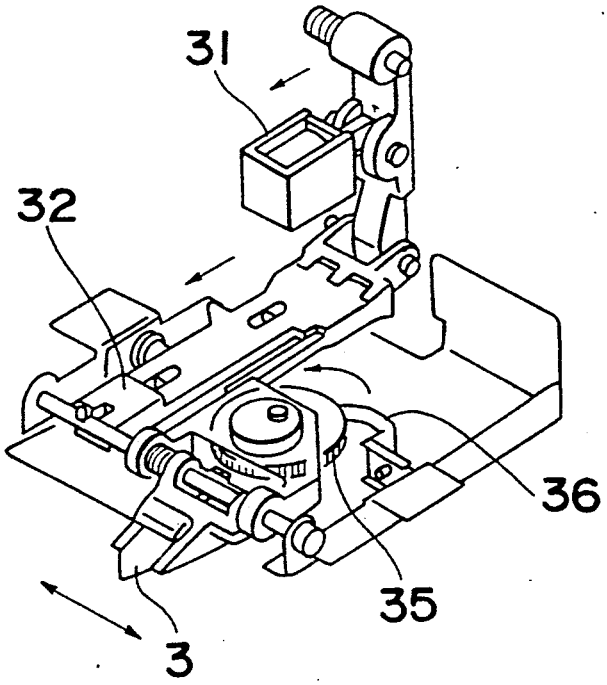

With respect to the on-off mechanism shown in FIG. 14, separating pawl solenoid (31) is switched off until the transfer paper (2) arrives at a previously appointed position so that the separating pawls (3) may not be engaged with the surface of the photosensitive member (1).

And, when the transfer paper (2) is guided to the photosensitive member (1) by means of timing rollers (14) and an arrival of the transfer paper (2) at the appointed position is detected by means of a detector (not shown), the separating pawl solenoid (31) is switches on for a certain appointed time.

Upon switching on the separating pawl solenoid (31) in the above described manner, a feeding pawl (32) is moved in the direction shown by an arrow (b), namely, towards the photosensitive member (1), to push connection pins (34) connecting the feeding pawl (32) with a fitting shaft (33), on which the separating pawl (3) is upward rotated together with the fitting shaft (33) to be engaged with the surface of the photosensitive member (1).

In the on-off mechanism shown in FIG. 14, a pressure for engaging the separating pawls (3) with the surface of the photosensitive member (1) in the above described manner is regulated by means of a spring (35) so that the separating pawl may be pressed against the surface of the photosensitive member (1) at a suitable force.

Furthermore, when the separating pawl (3) is slid in the axial direction of the photosensitive member (1) by the use of a sliding mechanism together with the above described on-off mechanism, an eccentric cam ratchet (35) is revolved by one tooth at a time when the separating pawl solenoid (31) is switches on to move the feeding pawls (32) towards the photosensitive member (1) in the above described manner. The separating pawl (3) is moved in the axial direction of the photosensitive member (1).

Under the condition that the separating pawl solenoid (31) is switched off, the eccentric cam ratchet (35) is prevented from being reversed by means of a reverse-preventing pawl (36).

And, when the separating pawl (3) is engaged with the surface of the photosensitive member (1) by the use of the above described on-off mechanism, a contact time of the separating pawl (3) is set at 500 msec per one passage of the transfer paper and a pressing force of the separating pawl (3) is set at 3 g by regulating the spring (35).

When the separating pawl (3) is slid in the axial direction of the photosensitive member (1) by the sliding mechanism, a moving span of the separating pawls (3) is set at about 5 mm so that the separating pawls (3) may be reciprocated one time during the time when the photosensitive member (1) is revolved about 50 times.

And, when an image is formed by the use of the above described copying machine, the positively chargeable photosensitive member is charged at +500 V and then an exposure of irradiated light is regulated followed by developing with a development bias voltage set at +150 V. When the negatively chargeable photosensitive member is charged at −500 V, the exposure of irradiated light is regulated followed by developing with the development bias voltage set at −150 V, to form a halftone image having an image concentration of about 0.7, respectively.

It will be below made clear from various kinds of experiments in which the surface roughness of the inclined surface portions (3c) of the separating pawls (3) brought into contact with the photosensitive member (1), a kind of the photosensitive layer in the photosensitive member (1), a kind and the layer-thickness of the surface protective layer formed on the surface of the photosensitive member (1), a mechanism for engaging the separating pawls (3) with the surface of the photosensitive member (1) and the like are varied that according to the examples conforming to the conditions according to the present invention is superior to the comparative examples not conforming to the conditions according to the present invention.

Before the above described experiments are carried out, the contact portions of the separating pawls (3), which are formed with stainless steel in the wedge-like shape and brought into contact with the surface of the photosensitive member (1), are ground by various kinds of grinding means to produce five kinds of separating pawls $A_1$–$A_5$ different in surface roughness.

Production of Separating Pawls $A_1$ to $A_8$

When the separating pawl $A_1$ made of stainless steel is produced, the contact portion of the separating pawl brought into contact with the surface of the photosensitive member is manually ground and finished by the use of a whetstone (#5000) on the market so as to give the maximum surface roughness of 0.52 μm to the contact portion. Its shape is shown in FIG. 1.

When the separating pawls $A_2$ and $A_3$ made of stainless steel are produced, the contact portions of the separating pawls brought into contact with the surface of the photosensitive member are buffed by means of a felt buff as a revolving frequency of the buff, a pressing force of the buff, a treating time and the like are regulated so as to give the maximum surface roughness of 0.21 μm to the contact portion of the separating pawl $A_2$ and the maximum surface roughness of 0.10 μm to the contact portion of the separating pawl $A_3$. Their shapes are shown in FIG. 1.

The buff treatment is a method in which an article to be ground is pressed with a buff plate. The buff plate is produced by fulling animal hairs, such as wool, deer hair and rabbit hair, and the like, or chemical fibers, such as nylon, rayon polyester and the like, or chemical fibers, such as nylon, rayon polyester and the like, by adding moisture, heat and pressure or by binding these fibers with a resin, revolved at an appointed pressure to mechanically grind the contact portions.

A surface polished by this method is characterized in that a slight surface unevenness of a finished surface is not orientated.

It can be thought that this characteristic is desirable for the finishing method of the separating pawls, that is this characteristic acts upon also the photosensitive member having the structure that the hard thin layer is formed on the soft photosensitive layer not so as to produce cracks and defects in the surface protective layer.

Figure 16:
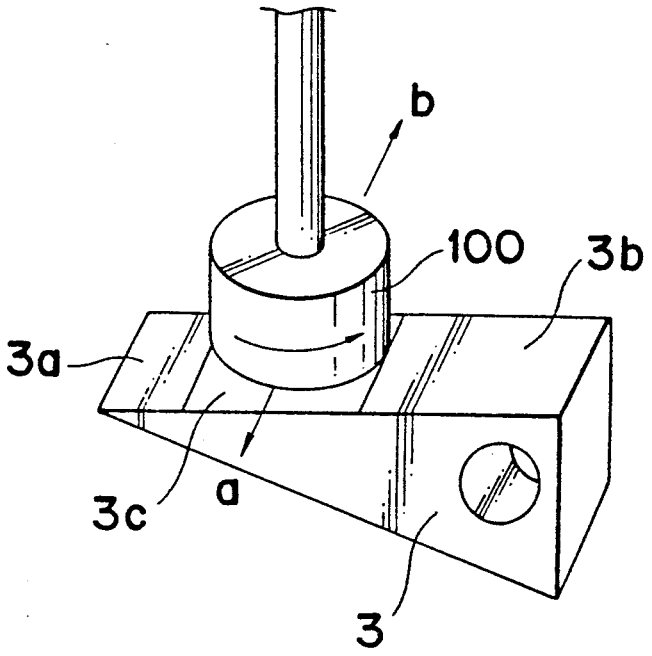
FIG. 16 shows how to buff a separating pawl.

As shown in FIG. 16, a separating pawl is abraded by means of a buff (100) made of wool having a diameter of 16 mm and a thickness of 5 mm (a density of fibers: 0.3 g/cm$^3$) at a load of 5 gf with revolving the buff at a revolving frequency of 100 rpm and moving the buff in the directions shown by arrows a, b to obtain the separating pawl $A_2$ having the contact portion (3*c*) of 0.21 μm in maximum surface roughness.

A separating pawl is treated in the same manner as for the separating pawl $A_2$ excepting that the load is changed to 1 gf to obtain the separating pawl $A_3$ having the contact portion (3*c*) of 0.10 μm in maximum surface roughness.

Pure water is given to the abraded portions during the abrading process in order to cool the article to be ground.

When the separating pawls $A_4$, $A_5$ made of stainless steel are produced, the contact portions of the separating pawls brought into contact with the surface of the photosensitive member are subjected to an electropolishing process in a polishing bath containing nitric acid and glacial acetic acid with regulating a mixture ratio of nitric acid and glacial acetic acid, a quantity of electric current and the like to electropolish the contact portions of the separating pawls brought into contact with the surface of the photosensitive member to give the maximum surface roughness of 0.07 μm to the contact portion of the separating pawl $A_4$ and the maximum surface roughness of 0.05 μm to the contact portion of the separating pawl $A_5$. Their shapes are shown in FIG. 1.

The electropolish is a chemical polishing method in which a metallic article to be polished is electrified in a suitable electrolyte with it as an anode to rapidly dissolve a surface thereof, in particular convex portions of the surface, whereby flattening the surface.

The electropolish is also characterized in that a remarkably slight surface unevenness of the finished surface is not oriented as can be seen in the buffing. But, the electropolish is characterized in that an uneven condition is smooth and no burr is produced. This condition is different from the grindstone polishing.

In order to obtain the suitable uneven condition, the composition of the polishing bath and the quantity of electric current must be regulated. But, the treatment in a mixture bath containing 1 liter of nitric acid and 40 g of glacial acetic acid for 5 minutes at 30° C. in bath-temperature and 30 A/dm$^2$ in current density with connecting with an anode leads to the obtainment of the separating pawl $A_4$ of 0.07 μm in maximum surface roughness. The similar treatment for 10 minutes leads to the obtainment of the separating pawl $A_5$ of which maximum surface roughness is 0.05 μm.

When the separating pawl $A_6$ is produced, a separating pawl, which is crudely processed in a milling machine to be shaped as shown in FIG. 7, is subjected to the electropolish in the same manner as in the case where the separating pawls $A_4$, $A_5$ are produced to form the contact portion (3*c*). Every one of two surfaces (3*c*-1) and (3*c*-2) has the maximum surface roughness of 0.05 μm.

When the separating pawl $A_7$ is produced, a separating pawl, which is crudely processed in a lathe and a milling machine to be shaped as shown in FIG. 9, is subjected to the electropolish in the same manner as in the cases where the separating pawls $A_4$, $A_5$ are produced so as to give the maximum surface roughness of 0.05 μm to the contact portion (3*c*).

The separating pawl $A_8$ having the contact portion (3*c*) of 0.05 μm in maximum surface roughness is produced in a manner similar to the separating pawl $A_2$, except that a same shaped disk made of a polyacetal resin with an amorphous carbon layer of 1 μm thickness having a Vickers hardness of 1,500 formed on a lower side thereof is used in place of the buff shown in FIG. 16 and the number of scanning times is 100.

In the determination of the maximum surface roughness at the contact portion of the respective separating pawls $A_1$ to $A_8$, the surface roughness is measured by the use of a tracer-type surface roughness tester (Surfcom 500A manufactured by Tokyo Seimitsu K. K..) within a range of 0.25 mm in a direction of inclined surface of the separating pawl and a direction meeting at right angles with the direction of inclined surface of the separating pawl, respectively, from a center of the contact portion of the separating pawl brought into contact with the surface of the photosensitive member in accordance with JIS-B-0601, as above described. The highest height within the range is referred to as a maximum surface roughness.

On the other hand, two kinds of organic photosensitive members $B_1$, $B_2$ produced in the following manner are used as a photosensitive member and a suitable surface protective layer is formed on the surface of the organic photosensitive members $B_1$, $B_2$ depending upon the respective experiments.

Production of the Orqanic Photosensitive Member $B_1$

In the production of the organic photosensitive member $B_1$, a mixture containing 25 parts by weight of special α-type copper phthalocyanine (made by Toyo Inki K. K..), 50 parts by weight of a thermosetting acrylmelamine resin (a mixture of A-405 and Super Beckamine J820 produced by Dainihon Inki K. K..), 25 parts by weight of 4-diethylaminobenzaldehyde-diphenylhydrazone and 500 parts by weight of an organic solvent [a mixture of xylene and butanol (7:3 by weight)] is pulverized and dispersed for 10 hours in a ball mill.

And, the resulting dispersion is applied to a cylindrical aluminum substrate having 80 mm in diameter 330 mm in length by a dipping method so that a layer-thickness may be 15 μm after dried and baked. Then, the applied dispersion is baked for 1 hour at 150° C. to produce a positively chargeable organic photosensitive member $B_1$ with an organic photosensitive layer formed on the electrically conductive substrate.

Production of the Organic Photosensitive Member $B_2$

In the production of the organic photosensitive member $B_2$, a mixture containing 1 part by weight of a bisazo pigment (Chloro-dian-blue CDB) as a charge-generating material, 1 part by weight of a polyester resin (V-200 produced by Toyobo K. K..) and 100 parts by weight of cyclohexanone is dispersed for 13 hours in a sand grinder.

And, the obtained dispersion is applied to a cylindrical aluminum substrate having 80 mm in diameter and 330 mm in length by a dipping method so that a layer-thickness may be 0.3 μm after dried. Then, the applied dispersion is dried to form a charge-generating layer on the aluminum substrate.

Subsequently, a solution of 1 part by weight of 4-diethylaminobenzaldehyde-diphenylhydrazone (DEH) as a charge-transporting material and 1 part by weight of a polycarbonate resin (K-1300 produced by Teijin Kasei K. K..) in 6 parts by weight of THF is applied to the charge-generating layer formed on the aluminum substrate in the above described manner so that a layer-thickness may be 15 μm after dried. Then, the applied solution is dried to form a charge-transporting layer on the charge-generating layer, whereby producing the negatively chargeable organic photosensitive member $B_2$ with the charge-generating layer and the charge-transporting layer formed on the aluminum substrate in this order.

A Vickers hardness of the organic photosensitive members $B_1$, $B_2$ obtained in the above described manner was measured. The Vickers hardness of a surface of the organic photosensitive member $B_1$ is 70 and that of a surface of the organic photosensitive member $B_2$ is 40. The Vickers hardness is measured by means of a thin-layer hardness tester (MHA-400 produced by Nihon Denki K. K..).

In addition, in the formation of a surface protective layer on the surfaces of the organic photosensitive members $B_1$, $B_2$ produced in the above described manner, an amorphous surface protective layer containing at least carbon atoms and hydrogen atoms is formed on the surfaces of the respective organic photosensitive members $B_1$, $B_2$ as a butadiene gas as a material gas and a hydrogen gas as a carrier gas is flowed into a known joint-type cylindrical plasma CVD apparatus, for example, an apparatus disclosed in U.S. Pat. No. 4,801,515, and a pressure, an electric power and the like are regulated during a discharge.

Production of the Organic Photosensitive Member $B_3$

In the production of the organic photosensitive member $B_3$, a mixture containing 1 part by weight of a bisazo pigment (Chloro-dian-blue CDB) as a charge-generating material, 1 part by weight of a polyester resin (V-200 produced by Toyobo K. K..) and 100 parts by weight of cyclohexanone is dispersed for 13 hours in a sand grinder.

And, the obtained dispersion is applied to a cylindrical aluminum substrate having 80 mm in diameter and 330 mm in length by a dipping method so that a layer-thickness may be 0.3 μm after dried. Then, the applied dispersion is dried to form a charge-generating layer on the aluminum substrate.

Subsequently, a solution of 1 part by weight of 4-diethylaminobenzaldehyde-diphenylhydrazone (DEH) as a charge-transporting material and 1 part by weight of a polyester resin (V-200 produced by Toyo Boseki K. K..) in 6 parts by weight of THF is applied to the charge-generating layer formed on the aluminum substrate in the above described manner so that a layer-thickness may be 15 μm after dried. Then, the applied solution is dried to form a charge-transporting layer on the charge-generating layer, whereby producing the negatively chargeable organic photosensitive member $B_3$ with the charge-generating layer and the charge-transporting layer formed on the aluminum substrate in this order.

A Vickers hardness of the organic photosensitive member $B_3$ is 5, which is measured in the same manner as for the organic photosensitive members $B_1$, $B_2$.

Production of the Organic Photosensitive Member $B_4$

In the production of the organic photosensitive member $B_4$, a mixture containing 1 part by weight of a bisazo pigment (Chloro-dian-blue CDB) as a charge-generating material, 1 part by weight of a polyester resin (V-200 produced by Toyobo K. K..) and 100 parts by weight of cyclohexanone is dispersed for 13 hours in a sand grinder.

The obtained dispersion is applied to a cylindrical aluminum substrate having 80 mm in diameter and 330 mm in length by a dipping method so that a layer-thickness may be 0.3 μm after dried. Then, the applied dispersion is dried to form a charge-generating layer on the aluminum substrate.

Subsequently, a solution of 1 part by weight of 4-diethylaminobenzaldehyde-diphenylhydrazone (DEH) as a charge-transporting material and 1 part by weight of methyl methacrylate PMMA (BR-85 produced by Mitsubishi Reyon K. K..) in 6 parts by weight of THF is applied to the charge-generating layer formed on the aluminum substrate in the above described manner so that a layer-thickness may be 15 μm after dried. Then, the applied solution is dried to form a charge-transporting layer on the charge-generating layer, whereby producing the negatively chargeable organic photosensitive member $B_4$ with the charge-generating layer and the charge-transporting layer formed on the aluminum substrate in this order.

A vickers hardness of the organic photosensitive member $B_4$ is 100, which is measured in the same manner as for the organic photosensitive members $B_1$, $B_2$.

In the evaluation of characteristics of the respective surface protective layers and photosensitive layers formed in the above described manner, an absorption coefficient $\alpha$ for a light having a wavelength of 450 nm is measured by means of a visible-ultraviolet spectrophotometer (UVIDEC-610 produced by Nihon Bunko Kogyo K. K..) and the Vickers hardness Hv of a surface is measured by means of a thin-layer hardness tester (MHA-400 produced by Nihon Denki K. K..).

EXAMPLE 1 TO 3 AND COMPARATIVE EXAMPLE 1, 2

In these Examples 1 to 3 and Comparative Examples 1, 2, the above described positively chargeable organic photosensitive member $B_1$ is used, and, in order to prevent charges from being injected from the surface of the organic photosensitive member $B_1$, a transparent amorphous carbon layer, of which absorption of visible rays can be negligible, having 0.11 μm in thickness, 3000 in absorption coefficient α for a light of 450 nm and 700 in Vickers hardness Hv, is formed on the surface of the organic photosensitive member $B_1$ as a surface protective layer in the known joint-type cylindrical plasma CVD apparatus.

As to the separating pawl brought into contact with the surface of such the photosensitive member to separate the transfer paper, the separating pawl, of which maximum surface roughness of the contact portion brought into contact with the surface of the photosensitive member is smaller than the layer-thickness of the surface protective layer of 0.11 μm, is used in Examples 1-3. The separating pawl $A_4$, of which maximum surface roughness of the contact portion is 0.10 μm, is used, in Example 1. The separating pawl $A_4$, of which maximum surface roughness of the contact portion is 0.07 μm, is used, in Example 2. The separating pawl $A_5$, of which maximum surface roughness of the contact portion is 0.05 μm is used in Example 3.

In Comparative Examples 1 and 2, the separating pawl, of which maximum surface roughness of the contact portion brought into contact with the surface of the photosensitive member is rougher than the layer-thickness of the surface protective layer of 0.11 μm, is used. The separating pawl $A_1$, of which maximum surface roughness of the contact portion is 0.52 μm, is used in Comparative Example 1. The separating pawl $A_2$, of which maximum surface roughness of the contact portion is 0.21 μm, is used in Comparative Example 2.

The organic photosensitive member $B_1$ provided with the surface protective layer of 0.11 μm in thickness formed thereon is installed in the above described copying machine, and the above described respective separating pawls $A_1$ to $A_5$ are brought into contact with the surface of the organic photosensitive member $B_1$ by means of the above described on-off mechanisms. The halftone image is formed on 20000 pieces of copying paper in the above described manner to evaluate the image noise.

The results are shown in the following Table 1.

TABLE 1

| | Evaluation of image noise: number of pieces of paper in durability test with respect to copy | | | | | |
|---|---|---|---|---|---|---|
| | 10 | 100 | 1000 | 5000 | 10000 | 20000 |
| Example 1 | W | W | W | W | W | W |
| Example 2 | W | W | W | W | W | W |
| Example 3 | W | W | W | W | W | W |
| Com. Example 1 | W | W | W | W | W | W |
| Com. Example 2 | W | W | W | W | W | W |

In Table 1 and the subsequent other Tables, the symbol " " indicates that the copied images are good and a difference between white or black stripe-like noise portions and other portions is 0.1 or less in image-concentration. The symbol " " indicates that the difference is 0.1 to 0.3, but no problem occurs in the practical use. The symbol " " indicates the difference is larger than 0.3 and noises are unsuitably noticeable. The letter "W" indicates white stripe-like noises, and the letter "B" indicates black stripe-like noises.

In the measurement of image-concentration, a Sakura microdensitometer PDM-5(trade name) produced by Konishiroku Shashin Kogyo K. K. is used.

As obvious from these results, in Examples 1 to 3, in which the separating pawls $A_3$ to $A_5$ with the maximum surface roughness of the contact portion brought into contact with the surface of the photosensitive member are used, in particular in Example 1 using the separating pawl $A_3$ having the maximum surface roughness smaller than the layer-thickness of the surface protective layer by merely 0.01 μm, slight scratches resulted from the separating pawl is not observed and some white stripe-like noises, which are not called in question in the practical use, is not produced on the surface protective layer formed on the surface of the photosensitive member until the copying test is repeated 20000 times. In Examples 2, 3 using the separating pawls $A_4$, $A_5$ having the maximum surface roughness smaller than that of the separating pawl $A_3$, the white stripe-like image noises are not produced at all and the good image having no image noise is formed for a long time.

On the contrary, in Comparative Example 1 using the separating pawl $A_1$ with the maximum surface roughness of the contact portion brought into contact with the surface of the photosensitive member thereof rougher than the layer-thickness of the surface protective layer formed on the surface of the photosensitive member, the surface protective layer formed on the photosensitive member is scratches to a level in a deeper than the layer-thickness thereof and charges are injected from the scratched portions to distinctly produce the white stripe-like image noises on the formed image after the copying test is repeated merely 10 times. In comparative Example 2 using the separating pawl $A_2$, the same results as in Comparative Example 1 are brought about after the copying test is repeated merely 100 times.

In addition, it is found from the above described results that if the maximum surface roughness of the contact portion of the separating pawl is set at $\frac{2}{3}$ or less times the layer-thickness of the surface protective layer formed on the surface of the photosensitive member, more preferable results can be obtained.

Examples 4 to 7 and Comparative Example 3

In these Examples 4 to 7 and Comparative Example 3, in the formation of the surface protective layer composed of an amorphous carbon layer having 3000 in absorption coefficient α for a light of 450 nm 3000 and about 700 in the Vickers hardness Hv on the surface of the organic photosensitive member $B_1$ in order to prevent charges from being injected from the surface of the photosensitive member $B_1$, an amorphous carbon layer of 0.23 μm thickness is formed on the surface of the organic photosensitive member $B_1$ in the above described joint-type cylindrical plasma CVD apparatus for nearly double a film-forming time.

As to the separating pawl brought into contact with the surface of such the photosensitive member to separate the transfer paper, the separating pawl, of which maximum surface roughness of the contact portion brought into contact with the surface of the photosensitive member is smaller than the layer-thickness of the surface protective layer of 0.23 μm, is used in Examples 4 to 7. The separating pawl $A_2$, of which maximum surface roughness of the contact portion is 0.21 μm, is used, in Example 4. The separating pawl $A_3$, of which maximum surface roughness of the contact portion is 0.10 μm, is used in Example 5. The separating pawl $A_4$, of which maximum surface roughness of the contact portion is 0.07 μm, is used in Example 6. The separating pawl $A_5$, of which maximum surface roughness of the contact portion is 0.05 μm, is used in Example 7. On the other hand, separating pawl $A_1$, of which maximum surface roughness of the contact portion brought into contact with the surface of the photosensitive member of 0.52 μm is larger than the layer-thickness of the surface protective layer of 0.23 μm, is used in Comparative Example 3.

In Examples 4 to 7 and Comparative Example 3, durability test with respect to copy was conducted using 20000 pieces of A4 papers in the same manner as in the above described Examples 1 to 3 and Comparative Example 3 to evaluate the image noise after the appointed times of copying.

The results are shown in the following Table 2.

TABLE 2

| | Evaluation of image noise: number of pieces of paper in durability test with respect to copy | | | | | |
|---|---|---|---|---|---|---|
| | 10 | 100 | 1000 | 5000 | 10000 | 20000 |
| Example 4 | W | W | W | W | W | W |
| Example 5 | W | W | W | W | W | W |
| Example 6 | W | W | W | W | W | W |
| Example 7 | W | W | W | W | W | W |
| Com. Example 3 | W | W | W | W | W | W |

As obvious also from these results, in Examples 4 to 7, in which the separating pawls $A_2$ to $A_5$ with the maximum surface roughness of the contact portion brought into contact with the surface of the photosensitive member smaller than the layer-thickness of the surface protective layer formed on the surface of the photosensitive member is used, the good image having little white stripe-like image noises is formed for a long time. In Comparative Example 3 using the separating pawl $A_1$ with the maximum surface roughness of the contact portion brought into contact with the surface of the photosensitive member thereof larger than the layer-thickness of the surface protective layer formed on the surface of the photosensitive member, the surface protective layer formed on the photosensitive member is scratched to a level deeper than the layer-thickness thereof and charges are injected from the scratched portions to distinctly produce the white stripe-like image noises on the formed image after the copying test is repeated merely 100 times.

Examples 8 to 10 and Comparative Examples 4, 5

In these Examples 8 to 10 and Comparative Examples 4, 5, the above described negatively chargeable organic photosensitive member $B_2$ is used, and, in order to prevent harmful lights from being incident upon the photosensitive layer of the organic photosensitive member $B_2$, an amorphous carbon layer having 0.11 μm in thickness, 40000 in absorption coefficient $\alpha$ for a light of 450 nm is formed on the surface of the organic photosensitive member $B_2$ as a surface protective layer in the above described joint-type cylindrical plasma CVD apparatus.

As to the separating pawl brought into contact surface of such the photosensitive member to separate the transfer paper, in Examples 8 to 10, the separating pawl, of which maximum surface roughness of the contact portion brought into contact with the surface of the photosensitive member is smaller than the layer-thickness of the surface protective layer of 0.11 μm, is used. In particular in Example 8, the separating pawl $A_3$, of which maximum surface roughness of the contact portion is 0.10 μm, is used. In Example 9, the separating pawl $A_4$, of which maximum surface roughness of the contact portion is 0.07 μm, is used. In Example 10, the separating pawl $A_5$, of which maximum surface roughness of the engaging portion is 0.05 μm, is used.

On the other hand, in Comparative Examples 4, 5, the separating pawl, of which maximum surface roughness of the contact portion brought into contact with the surface of the photosensitive member is larger than the layer-thickness of the surface protective layer of 0.11 μm, is used. In particular in Comparative Example 4, the separating pawl $A_1$, of which maximum surface roughness of the contact portion is 0.52 μm, is used. In Comparative Example 5, the separating pawl $A_2$, of which maximum surface roughness of the engaging portion is 0.21 μm, is used.

The organic photosensitive member $B_2$ provided with the surface protective layer of 0.11 μm thickness formed thereon is installed in the above described copying machine, and the above described respective separating pawls $A_1$ to $A_5$ are brought into contact with the surface of the organic photosensitive member $B_2$ by means of the above described on-off mechanisms. The halftone image is formed on 20000 pieces of copying paper in the above described manner to evaluate the image noise.

The results are shown in the following Table 3.

TABLE 3

| | Evaluation of image noise: number of pieces of paper in durability test with respect to copy | | | | | |
|---|---|---|---|---|---|---|
| | 10 | 100 | 1000 | 5000 | 10000 | 20000 |
| Example 8 | W | W | W | W | W | W |
| Example 9 | W | W | W | W | W | W |
| Example 10 | W | W | W | W | W | W |
| Com. Example 4 | W | W | W | W | W | W |
| Com. Example 5 | W | W | W | W | W | W |

As obvious from these results, also in the case where the surface protective layer is formed on the surface of the photosensitive member in order to prevent harmful lights from being incident upon the photosensitive layer, in Examples 8 to 10 using the separating pawls $A_3$ to $A_5$ having the maximum surface roughness of the contact portion smaller than the layer-thickness of the surface protective layer, the white stripe-like image noises are hardly produced and thus the good image can be formed for a long time.

On the contrary, in Comparative Example 4 using the separating pawl $A_1$ with the maximum surface roughness of the contact portion brought into contact with the surface of the photosensitive member thereof larger than the layer-thickness of the surface protective layer formed on the surface of the photosensitive member, the surface protective layer formed on the photosensitive member is scratched to a level deeper than the layer-thickness thereof and the harmful lights arrive at the photosensitive layer in the scratched portions to distinctly produce the white stripe-like image noises in the copied image after the copying test is repeated merely 10 times. In Comparative Example 5 using the separating pawl $A_2$, the same results as in Comparative Example 4 are obtained after the copying test is repeated merely 100 times.

In addition, in Comparative Example 4 using the separating pawl $A_1$, the photosensitive layer is gradually deteriorated in sensitivity due to the incidence of the harmful lights thereupon and thus the black stripe-like image noises are slightly observed after the copying test is repeated 20000 times.

Examples 11 to 14 and Comparative Example 6

In these Examples 11 to 14 and Comparative Example 6, in the formation of the surface protective layer on the surface of the above described organic photosensitive member $B_2$ in order to prevent harmful lights from being incident upon the photosensitive layer in the same manner as in Examples 8 to 10 and Comparative Examples 4, 5, the surface protective layer composed of an amorphous carbon layer having 30000 in absorption coefficient $\alpha$ for a light 450 nm about 700 in Vickers hardness Hv of and 0.23 $\mu$m in layer-thickness is formed on the surface of the organic photosensitive member $B_2$ in the above described joint-type cylindrical plasma CVD apparatus for nearly double a film-forming time while regulating the film-forming conditions.

As to the separating pawl brought into contact with the surface of such the photosensitive member to separate the transfer paper, in Examples 11 to 14, the separating pawl, of which maximum surface roughness of the contact portion brought into contact with the surface of the photosensitive member is smaller than the layer-thickness of the surface protective layer of 0.23 $\mu$m, is used. In Example 11, the separating pawl $A_2$, of which maximum surface roughness of the contact portion is 0.21 $\mu$m, is used. In Example 12, the separating pawl $A_3$, of which maximum surface roughness of the contact portion is 0.10 $\mu$m, is used. In Example 13, the separating pawl $A_4$, of which maximum surface roughness of the contact portion is 0.07 $\mu$m, is used. In Example 14, the separating pawl $A_5$, of which maximum surface roughness is 0.05 $\mu$m, is used.

On the other hand, in Comparative Examples 6, the separating pawl $A_1$, of which maximum surface roughness of the engaging portion brought into contact with the surface of the photosensitive member is 0.52 $\mu$m larger than the layer-thickness of the surface protective layer of 0.23 $\mu$m, is used.

A durability test with respect to copy was conducted using 20000 pieces of A4 papers in the same manner as in Examples 8 to 10 and Comparative Examples 4, 5 to evaluate the image noise after the copying is repeated appointed times.

The results are shown in the following Table 4.

TABLE 4

| | Evaluation of image noise: number of pieces of paper in durability test with respect to copy | | | | | |
|---|---|---|---|---|---|---|
| | 10 | 100 | 1000 | 5000 | 10000 | 20000 |
| Example 11 | W | W | W | W | W | W |
| Example 12 | W | W | W | W | W | W |
| Example 13 | W | W | W | W | W | W |
| Example 14 | W | W | W | W | W | W |
| Com. Example 6 | W | W | W | W | W | W |

As obvious from these results, in Examples 11 to 14 using the separating pawls $A_2$ to $A_5$ having the maximum surface roughness of the contact portion smaller than the layer-thickness of the surface protective layer, the white stripe-like image noises are hardly produced and thus the good image can be formed for a long time.

In Comparative Example 6 using the separating pawl $A_1$ with the maximum surface roughness of the contact portion brought into contact with the surface of the photosensitive member thereof larger than the layer-thickness of the surface protective layer formed on the surface of the photosensitive member, the surface protective layer formed on the photosensitive member is scratched to a level deeper than the layer-thickness thereof and the harmful lights arrive at the photosensitive layer in the scratched portions to increase the sensitivity undesirably and thus distinctly produce the white stripe-like image noises in the copied image after the copying test is repeated merely 100 times.

Examples 15 to 17 and Comparative Examples 7, 8

In these Examples 15 to 17 and Comparative Examples 7 and 8, the above described negatively chargeable organic photosensitive member $B_2$ is used and in order to improve an abrasion resistance of the surface of the organic photosensitive member $B_2$, the surface protective layer composed of an amorphous carbon layer having 3000 in absorption coefficient $\alpha$ for a light of 450 nm, 1500 in Vickers hardness Hv and 0.11 $\mu$m in layer-thickness is formed on the surface of the organic photosensitive member $B_2$ in the above described joint-type cylindrical plasma CVD apparatus.

As to the separating pawl brought into contact with the surface of such the photosensitive member, on which the surface protective layer is formed, in Examples 15 to 17, the separating pawl, of which maximum surface roughness of the contact portion brought into contact with the surface of the photosensitive member is smaller than the layer-thickness of the surface protective layer of 0.11 $\mu$m, is used. In Example 15, the separating pawl $A_3$, of which maximum surface roughness of the contact portion is 0.10 $\mu$m, is used. In Example 16, the separating pawl $A_4$, of which maximum surface roughness of the contact portion is 0.07 $\mu$m, is used. In Example 17, the separating pawl $A_5$, of which maximum surface roughness is 0.05 $\mu$m, is used.

On the other hand, in Comparative Examples 7, 8, the separating pawl, of which maximum surface roughness of the contact portion brought into contact with the surface of the photosensitive member is larger than the layer-thickness of the surface protective layer of 0.11 $\mu$m, is used. In Comparative Example 7, the separating pawl $A_1$, of which maximum surface roughness of the contact portion is 0.52 $\mu$m, is used. In Comparative Example 8, the separating pawl $A_2$, of which maximum surface roughness of the contact portion is 0.21 $\mu$m, is used.

The organic photosensitive member $B_2$ with the surface protective layer of 0.11 $\mu$m thickness is installed in the above described copying machine. The above described separating pawls $A_1$ to $A_5$ are brought into contact with the surface of the photosensitive member by means of the above described sliding mechanism in addition to the above described on-off mechanism to evaluate the image noise after the copying is repeated appointed times.

The results are shown in the following Table 5.

TABLE 5

| | Evaluation of image noise: number of pieces of paper in durability test with respect to copy | | | | | |
|---|---|---|---|---|---|---|
| | 10 | 100 | 1000 | 5000 | 10000 | 20000 |
| Example 15 | B | B | B | B | B | B |
| Example 16 | B | B | B | B | B | B |

TABLE 5-continued

| | Evaluation of image noise: number of pieces of paper in durability test with respect to copy | | | | | |
|---|---|---|---|---|---|---|
| | 10 | 100 | 1000 | 5000 | 10000 | 20000 |
| Example 17 | B | B | B | B | B | B |
| Com. Example 7 | B | B | B | B | B | B |
| Com. Example 8 | B | B | B | B | B | B |

As obvious from these results, also in the case where the surface protective layer is formed on the surface of the photosensitive member in order to improve an abrasion resistance of the surface of the photosensitive member, in Examples 15 to 17 using the separating pawls $A_3$ to $A_5$ having the maximum surface roughness of the contact portion smaller than the layer-thickness of the surface protective layer, the surface protective layer formed on the surface of the photosensitive member is hardly scratched by the separating pawl and thus the good image can be formed for a long time.

On the contrary, in Comparative Example 7 using the separating pawl $A_1$ with the maximum surface roughness of the contact portion brought into contact with the surface of the photosensitive member thereof larger than the layer-thickness of the surface protective layer formed on the surface of the photosensitive member, the surface protective layer is scratches in an increased width and a depth larger than the layer-thickness thereof by the separating pawls slid by means of the above described sliding mechanism to expose the organic photosensitive layer. The exposed organic photosensitive layer is further scraped by means of a cleaning blade to increase a quantity of surface charge in the scratched portions. The black stripe-like image noises in the copied image is produced after the copying process is repeated 5000 times in Comparative Example 8. The same results as in Comparative Example 7 are brought about after the copying process is repeated 10000 times.

Examples 18 to 21 and Comparative Example 9

In these Examples 18 to 21 and Comparative Example 9, in order to improve an abrasion resistance of the surface of the organic photosensitive member $B_2$ in the same manner as in Examples 15 to 17 and Comparative Examples 7, 8, the surface protective layer composed of an amorphous carbon layer having 3000 in absorption coefficient $\alpha$ for a light of 450 nm, 1500 in Vickers hardness Hv and the layer-thickness of 0.23 $\mu$m is formed on the surface of the organic photosensitive member $B_2$ in the above described joint-type cylindrical plasma CVD apparatus for nearly double the film-forming time.

As to the separating pawl brought into contact with the surface of such the photosensitive member, on which the surface protective layer is formed, in Examples 18 to 21, the separating pawl, of which maximum surface roughness of the contact portion brought into contact with the surface of the photosensitive member is smaller than the layer-thickness of the surface protective layer of 0.23 $\mu$m, is used. In Example 18, the separating pawl $A_2$, of which maximum surface roughness of the contact portion is 0.21 $\mu$m, is used. In Example 19, the separating pawl $A_3$, of which maximum surface roughness of the contact portion is 0.10 $\mu$m, is used. In Example 20, the separating pawl $A_4$, of which maximum surface roughness is 0.07 $\mu$m, is used. In Example 21, the separating pawl $A_5$, of which maximum surface roughness is 0.05 $\mu$m, is used.

On the other hand, in Comparative Example 9, the separating pawl $A_1$, of which maximum surface roughness of the contact portion brought into contact with the surface of the photosensitive member is 0.52 $\mu$m larger than the layer-thickness of the surface protective layer of 0.23 $\mu$m, is used.

A durability test with respect to copy was conducted using 20000 pieces of $A_4$ papers in the same manner as in Examples 15 to 17 and Comparative Examples 7, 8. The above described separating pawls $A_1$ to $A_5$ are brought into contact with the surface of the photosensitive member by means of the above described sliding mechanism in addition to the on-off mechanism to evaluate the image noises after the copying is repeated appointed times.

The results are shown in the following Table 6.

TABLE 6

| | Evaluation of image noise: number of pieces of paper in durability test with respect to copy | | | | | |
|---|---|---|---|---|---|---|
| | 10 | 100 | 1000 | 5000 | 10000 | 20000 |
| Example 18 | B | B | B | B | B | B |
| Example 19 | B | B | B | B | B | B |
| Example 20 | B | B | B | B | B | B |
| Example 21 | B | B | B | B | B | B |
| Com. Example 9 | B | B | B | B | B | B |

As obvious from these results, in Examples 18 to 21 using the separating pawls $A_2$ to $A_5$ having the maximum surface roughness of the contact portion brought into contact with the photosensitive member smaller than the layer-thickness of the surface protective layer, the surface protective layer formed on the surface of the photosensitive member is hardly scratched by the separating pawl and thus the good image can be formed for a long time.

On the contrary, in Comparative Example 9 using the separating pawl $A_1$ with the maximum surface roughness of the contact portion brought into contact with the surface of the photosensitive member thereof larger than the layer-thickness of the surface protective layer formed on the surface of the photosensitive member, the surface protective layer is scratched in an increased width and a depth larger than the layer-thickness thereof by the separating pawl slid by means of the sliding mechanism to increase a quantity of surface charges in the scratched portions when charged. The black stripe-like image noises are produced in the copied image after the copying process is repeated 10000 times.

EXAMPLE 22

In this Example 22, the above described negatively chargeable organic photosensitive member $B_3$ is used. In order to prevent harmful lights from being incident upon the photosensitive layer of the organic photosensitive member $B_3$, the surface protective layer composed of an amorphous carbon layer having 30000 in absorption coefficient $\alpha$ for a light of 450 nm about 200 in Vickers hardness Hv and 0.11 $\mu$m in thickness is formed on the surface of the organic photosensitive member $B_3$ in the above described joint-type cylindrical plasma CVD apparatus.

As to the separating pawl brought into contact with the surface of such the photosensitive member to separate the transfer paper, the separating pawl $A_6$, of which maximum surface roughness of the contact portion brought into contact with the surface of the photosensitive member is smaller than the layer-thickness of the surface protective layer of 0.11 μm, is used.

The organic photosensitive member $B_3$ with the surface protective layer of 0.11 μm thickness is installed in the above described copying machine and the above described separating pawl $A_6$ is brought into contact with the surface of the photosensitive member by means of the on-off mechanism. The halftone image is formed on 20000 pieces of copying paper to evaluate the image noise after the copying process is repeated appointed times.

The results are shown in the following Table 7.

TABLE 7

| | Evaluation of image noise: number of pieces of paper in durability test with respect to copy | | | | | |
|---|---|---|---|---|---|---|
| | 10 | 100 | 1000 | 5000 | 10000 | 20000 |
| Example 22 | W | W | W | W | W | W |

Also in this Example 22, no white stripe-like image noise is produced and thus the good image can be formed for a long time.

EXAMPLE 23

In this Example 23, the above described negatively chargeable organic photosensitive member $B_3$ is used. In order to prevent harmful lights from being incident upon the photosensitive layer of the organic photosensitive member $B_3$, the surface protective layer composed of an amorphous carbon layer having 30000 in absorption coefficient α for a light of 450 nm, 10000 in Vickers hardness Hv and the 0.11 μm in thickness is formed on the surface of the organic photosensitive member $B_3$ in the above described joint-type cylindrical plasma CVD apparatus.

As to the separating pawl brought into contact with the surface of such the photosensitive member to separate the transfer paper, the separating pawl $A_6$, of which maximum surface roughness of the contact portion brought into contact with the surface of the photosensitive member is smaller than the layer-thickness of the surface protective layer of 0.11 μm, is used.

The organic photosensitive member $B_3$ with the surface protective layer of 0.11 μm thickness is installed in the above described copying machine and the above described separating pawl $A_6$ is brought into contact with the surface of the photosensitive member by means of the on-off mechanism. The halftone image is formed on 20000 pieces of copying paper to evaluate the image noise after the copying process is repeated appointed times.

The results are shown in the following Table 8.

TABLE 8

| | Evaluation of image noise: number of pieces of paper in durability test with respect to copy | | | | | |
|---|---|---|---|---|---|---|
| | 10 | 100 | 1000 | 5000 | 10000 | 20000 |
| Example 23 | W | W | W | W | W | W |

Also in this Example 23, no white stripe-like image noise is produced and thus the good image can be formed for a long time.

EXAMPLE 24

In this Example 24, the above described negatively chargeable organic photosensitive member $B_4$ is used. In order to prevent harmful lights from being incident upon the photosensitive layer of the organic photosensitive member $B_4$, the surface protective layer composed of an amorphous carbon layer having 30000 in absorption coefficient α for a light of 450 nm, about 200 in Vickers hardness Hv of and 0.11 μm in thickness is formed on the surface of the organic photosensitive member $B_4$ in the above described joint-type cylindrical plasma CVD apparatus.

As to the separating pawl brought into contact with the surface of such the photosensitive member to separate pawl $A_7$, of which maximum surface roughness of the contact portion brought into contact with the surface of the photosensitive member is smaller than the layer-thickness of the surface protective layer of 0.11 μm, is used.

The organic photosensitive member $B_4$ with the surface protective layer of 0.11 μm thickness is installed in the above described copying machine and the above described separating pawl $A_7$ is brought into contact with the surface of the photosensitive member by means of the on-off mechanism. The halftone image is formed on 20000 pieces of copying paper to evaluate the image noise after the copying process is repeated appointed times.

The results are shown in the following Table 9.

TABLE 9

| | Evaluation of image noise: number of pieces of paper in durability test with respect to copy | | | | | |
|---|---|---|---|---|---|---|
| | 10 | 100 | 1000 | 5000 | 10000 | 20000 |
| Example 34 | W | W | W | W | W | W |

Also in this Example 24, no white stripe-like image noise is produced and thus the good image can be formed for a long time.

SUPPLEMENTARY EXAMPLE 25

In this Example 25, the above described negatively chargeable organic photosensitive member $B_4$ is used. In order to prevent harmful lights from being incident upon the photosensitive layer of the organic photosensitive member $B_4$, the surface protective layer composed of an amorphous carbon layer having 30000 in absorption coefficient α for a light of 450 nm about 10000 in Vickers hardness Hv and 0.11 μm in thickness is formed on the surface of the organic photosensitive member $B_4$ in the above described joint-type cylindrical plasma CVD apparatus.

As to the separating pawl brought into contact with the surface of such the photosensitive member to separate the transfer paper, the separating pawl $A_7$, of which maximum surface roughness of the contact portion brought into contact with the surface of the photosensitive member is smaller than the layer-thickness of the surface protective layer of 0.11 μm, is used.

The organic photosensitive member $B_4$ with the surface protective layer of 0.11 μm thickness is installed in the above described copying machine and the above described separating pawl $A_7$ is brought into contact with the surface of the photosensitive member by means of the on-off mechanism. The halftone image is formed on 20000 pieces of copying paper to evaluate the image noise after the copying process is repeated appointed times.

The results are shown in the following Table 10.

TABLE 10

| | Evaluation of image noise: number of pieces of paper in durability test with respect to copy | | | | | |
|---|---|---|---|---|---|---|
| | 10 | 100 | 1000 | 5000 | 10000 | 20000 |
| Example 25 | W | W | W | W | W | W |

Also in this Example 25, no white stripe-like image noise is produced and thus the good image can be formed for a long time.

EXAMPLE 26

In this Example 26, the above described negatively chargeable organic photosensitive member $B_3$ is used. In order to prevent harmful lights from being incident upon the photosensitive layer of the organic photosensitive member $B_3$, the surface protective layer composed of an amorphous carbon layer having 30000 in absorption coefficient $\alpha$ for a light of 450 nm about 10000 in Vickers hardness Hv of and 0.11 $\mu$m in thickness is formed on the surface of the organic photosensitive member $B_3$ in the above described joint-type cylindrical plasma CVD apparatus.

As to the separating pawl brought into contact with the surface of such the photosensitive member to separate the transfer paper, the separating pawl $A_8$, of which maximum surface roughness of the contact portion brought into contact with the surface of the photosensitive member is smaller than the layer-thickness of the surface protective layer of 0.11 $\mu$m, is used.

The organic photosensitive member $B_3$ with the surface protective layer of 0.11 $\mu$m thickness on the above described copying machine and the above described separating pawl $A_8$ is brought into contact with the surface of the photosensitive member by means of the on-off mechanism. The halftone image is formed on 20000 pieces of copying paper to evaluate the image noise after the copying process is repeated appointed times.

The results are shown in the following Table 11.

TABLE 11

| | Evaluation of image noise: number of pieces of paper in durability test with respect to copy | | | | | |
|---|---|---|---|---|---|---|
| | 10 | 100 | 1000 | 5000 | 10000 | 20000 |
| Example 26 | W | W | W | W | W | W |

Also in this Example 26, no white stripe-like image noise is produced and thus the good image can be formed for a long time.

As obvious from the above described respective results, even though the surface protective layer formed on the surface of the photosensitive member is different in layer-thickness and kind, in the case where the separating pawl with the maximum surface roughness of the contact portion brought into contact with the surface of the photosensitive member smaller than the layer-thickness of the surface protective layer is formed on the surface of the photosensitive member is used, various kinds of image noise are not produced and the good image can be obtained for a long time. These effects can not be obtained in the Comparative Examples using the separating pawl with the maximum surface roughness of the contact portion larger than the layerthickness of the surface protective layer.

As above described in detail, in the electrophotographic apparatus according to the present invention, when the separating pawl is brought into contact with the surface of the photosensitive member, on which the surface protective layer is formed, to separate the transfer paper from the surface of the photosensitive member, the maximum surface roughness of the contact portion of the separating pawl brought into contact with the surface of the photosensitive member is set so as to be smaller than the layer-thickness of the surface protective layer formed on the surface of the photosensitive member. Even though the portion having the maximum surface roughness of the separating pawl is brought into contact with the surface of the photosensitive member, the surface protective layer is shallowly scratched. The surface protective layer formed on the surface of the photosensitive member is not scratched to a level deeper than the layer-thickness thereof to injure the photosensitive layer by the separating pawl. Therefore, various kinds of stripe-like image noises are not produced in the copied image.

As a result, with the electrophotographic apparatus according to the present invention, the image of high quality can be formed for a long time.

What is claimed is:

1. An image forming apparatus comprising:

a photosensitive member including a photosensitive layer and a surface protective layer laminated onto the photosensitive layer, said photosensitive layer having a Vickers hardness of 5 to 100 and a thickness of 10 to 40 microns and said, protective layer having a Vickers hardness of 200 to 10000 and a thickness of 0.01 to 5 microns;

means for forming a toner image onto the surface of the photosensitive member;

means for transferring the toner image from the photosensitive member to a sheet by contacting the sheet against the photosensitive member;

means for separating the sheet on which the toner image is transferred from the surface of the photosensitive member by bringing a separating pawl into contact with the surface of the photosensitive member, said separating pawl having a maximum surface roughness of 0.005 to 3 microns and a thickness smaller than that of the surface protective layer; and means for pressing the separating pawl to the surface of the photosensitive member with a pressure of 0.5 to 5 g/mm.

2. An image-forming apparatus as set forth in claim 1, wherein the photosensitive layer is an organic photosensitive layer comprising binder resin and photosensitive material and the surface protective layer is an amorphous carbon surface protective layer.

3. An image forming apparatus comprising:

an endless shaped photosensitive member including an organic photosensitive layer formed with high molecular binder resin and an amorphous carbon surface protective layer produced by plasma polymerization, said photosensitive layer having a Vickers hardness of 5 to 100 and a thickness of 10 to 40 microns and said protective layer laminated onto the photosensitive layer having a Vickers hardness of 200 to 10000 and a thickness of 0.01 to 5 microns;

means for rotating the photosensitive member;

means for forming a toner image onto the surface of the photosensitive member;

means for transferring the toner image from the photosensitive member to a sheet by transporting the sheet to the photosensitive member along the rotating direction of the photosensitive member;

means for separating the sheet on which the toner image is transferred from the surface of the photosensitive member by bringing a separating pawl into contact with the surface of the photosensitive member, said separating pawl contacting with the photosensitive member at the downstream side of the transferring means with respect to the rotating direction of the photosensitive member to oppose the transporting sheet in counter-direction with respect to the transporting direction of the sheet wherein the separating pawl has a maximum surface roughness of 0.005 to 3 microns and a thickness smaller than that of the surface protective layer; and means for pressing the separating pawl to the surface of the photosensitive member with a pressure of 0.5 to 5 g/mm.

4. An image forming method comprising steps of:

providing a photosensitive member including a photosensitive layer and a surface protective layer laminated onto the photosensitive layer, said photosensitive layer having a Vickers hardness of 5 to 100 and a thickness of 10 to 40 microns and said protective layer having a Vickers hardness of 200 to 10000 and a thickness of 0.01 to 5 microns;

forming a toner image onto the surface of the photosensitive member;

transferring the toner image from the photosensitive member to a sheet by contacting the sheet against the photosensitive member;

separating the sheet on which the toner image is transferred from the surface of the photosensitive member by bringing a separating pawl into contact with the surface of the photosensitive member, said separating pawl having a maximum surface roughness of 0.005 to 3 microns and a thickness smaller than that of the surface protective layer; and pressing the separating pawl to the surface of the photosensitive member with a pressure of 0.5 to 5 g/mm.

5. An image-forming method as set forth in claim 4, wherein the photosensitive layer is an organic photosensitive layer comprising binder resin and photosensitive material and the surface protective layer is an amorphous carbon surface protective layer.

6. An image forming method comprising step of:

providing an endless shaped photosensitive member including an organic photosensitive layer formed with high molecular binder resin and an amorphous carbon surface protective layer produced by plasma polymerization, said photosensitive layer having a Vickers hardness of 5 to 100 and a thickness of 10 to 40 microns and said protective layer laminated onto the photosensitive layer having a Vickers hardness of 200 to 10000 and a thickness of 0.01 to 5 microns;

rotating the photosensitive member;

forming a toner image onto the surface of the photosensitive member;

transferring the toner image from the photosensitive member to a sheet by transporting the sheet to the photosensitive member along the rotating direction of the photosensitive member;

separating the sheet on which the toner image is transferred from the surface of the photosensitive member by bringing a separating pawl into contact with the surface of the photosensitive member, said separating pawl contacting with the photosensitive member at the downstream side of the transferring means with respect to the rotating direction of the photosensitive member to oppose the transporting sheet in counter-direction with respect to the transporting direction of the sheet wherein the separating pawl has a maximum surface roughness of 0.005 to 3 microns and a thickness smaller than that of the surface protective layer; and pressing the separating pawl to the surface of the photosensitive member with a pressure of 0.5 to 5 g/mm.

* * * * *